US010028544B2

(12) United States Patent
Teetzel

(10) Patent No.: US 10,028,544 B2
(45) Date of Patent: Jul. 24, 2018

(54) INTEGRATED BALLISTIC HELMET AND GAS MASK

(71) Applicant: WILCOX INDUSTRIES CORP., Newington, NH (US)

(72) Inventor: James W. Teetzel, Portsmouth, NH (US)

(73) Assignee: Wilcox Industries Corp., Newington, NH (US)

( * ) Notice: Subject to any disclaimer, the term of this patent is extended or adjusted under 35 U.S.C. 154(b) by 521 days.

(21) Appl. No.: 14/635,383

(22) Filed: Mar. 2, 2015

(65) Prior Publication Data

US 2016/0008640 A1 Jan. 14, 2016

Related U.S. Application Data

(60) Provisional application No. 61/948,822, filed on Mar. 6, 2014.

(51) Int. Cl.
*A62B 18/10* (2006.01)
*A42B 3/22* (2006.01)
(Continued)

(52) U.S. Cl.
CPC ..... *A42B 3/228* (2013.01); *A42B 3/221* (2013.01); *A42B 3/225* (2013.01); *A42B 3/288* (2013.01);
(Continued)

(58) Field of Classification Search
CPC .. A61J 7/0038; F41H 1/04; F41H 1/08; A62B 18/04; A62B 18/084; A62B 18/08; A62B 18/02; A62B 18/00; A62B 3/228; A62B 3/221; A62B 3/225; A62B 3/288; A62B 3/04; A62B 3/0406; A62B 3/105; A62B 3/28; A62B 17/04; A62B 9/04;
(Continued)

(56) References Cited

U.S. PATENT DOCUMENTS 2,174,503 A * 9/1939 Whipple ..... F16K 15/148 137/454.2
3,688,314 A * 9/1972 Rodney ..... A62B 18/04 128/201.24

(Continued)

*Primary Examiner* — Gregory Anderson
*Assistant Examiner* — Margaret Luarca
(74) *Attorney, Agent, or Firm* — McLane Middleton, Professional Association

(57) ABSTRACT

An integrated helmet and respirator system comprises a shell defining a helmet portion, the helmet portion being bounded by a peripheral edge. An annular shroud has an upper edge and a lower edge, the upper edge removably attached to the peripheral edge of the helmet portion and the lower edge attached to an annular frame member. A front portion of the annular shroud defines a visor. A one-way exhaust valve is received within an opening in the annular frame member. The one-way exhaust valve is configured to allow an exhalation gas exhaled by a user to exit an interior of the integrated helmet and respirator system and to prevent or minimize ambient air from entering the interior of the integrated helmet and respirator system. A neck dam extends downward from the frame and is configured to prevent or minimize ambient air from entering the interior of the integrated helmet and respirator system.

18 Claims, 22 Drawing Sheets

(51) Int. Cl.

| | |
|---|---|
| ***A62B 18/08*** | (2006.01) |
| ***A62B 18/04*** | (2006.01) |
| ***A42B 3/28*** | (2006.01) |
| *F41H 1/08* | (2006.01) |
| *A61J 7/00* | (2006.01) |

(52) U.S. Cl.
CPC ..... *A62B 18/04* (2013.01); *A62B 18/084* (2013.01); *A61J 7/0038* (2013.01); *F41H 1/08* (2013.01)

(58) Field of Classification Search
CPC ..... A42B 3/228; A42B 3/221; A42B 3/225; A42B 3/288; A42B 3/062; A42B 3/362
USPC ..... 128/201.23
See application file for complete search history.

(56) References Cited

U.S. PATENT DOCUMENTS

| | | | | |
|---|---|---|---|---|
| 2005/0199235 | A1* | 9/2005 | Borsari | A61M 16/0627 128/201.23 |
| 2007/0022520 | A1* | 2/2007 | Grassl | A42B 3/04 2/424 |
| 2010/0064405 | A1* | 3/2010 | McGovern | F41H 1/04 2/6.7 |

* cited by examiner

INTEGRATED BALLISTIC HELMET AND GAS MASK

CROSS REFERENCE TO RELATED APPLICATION

This application claims the benefit of provisional application No. 61/948,822, filed Mar. 6, 2014. The aforementioned application I incorporated herein by reference in its entirety.

BACKGROUND

The present disclosure relates generally to protective headgear such as a ballistic helmet or other helmet having a similar construction, such as a ballistic tactical helmet for use by law enforcement personnel, protective helmet for emergency responders, military field or combat helmets, or the like. More particularly, the present disclosure relates to a headgear system having an integral respirator or gas mask component for preventing inspiration of toxic airborne substances.

SUMMARY

An integrated helmet and respirator system comprises a shell defining a helmet portion, the helmet portion being bounded by a peripheral edge. An annular shroud has an upper edge and a lower edge, the upper edge removably attached to the peripheral edge of the helmet portion and the lower edge attached to an annular frame member. A front portion of the annular shroud defines a visor. A one-way exhaust valve is received within an opening in the annular frame member. The one-way exhaust valve is configured to allow an exhalation gas exhaled by a user to exit an interior of the integrated helmet and respirator system and to prevent or minimize ambient air from entering the interior of the integrated helmet and respirator system. A neck dam extends downward from the frame and is configured to prevent or minimize ambient air from entering the interior of the integrated helmet and respirator system.

BRIEF DESCRIPTION OF THE DRAWING

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
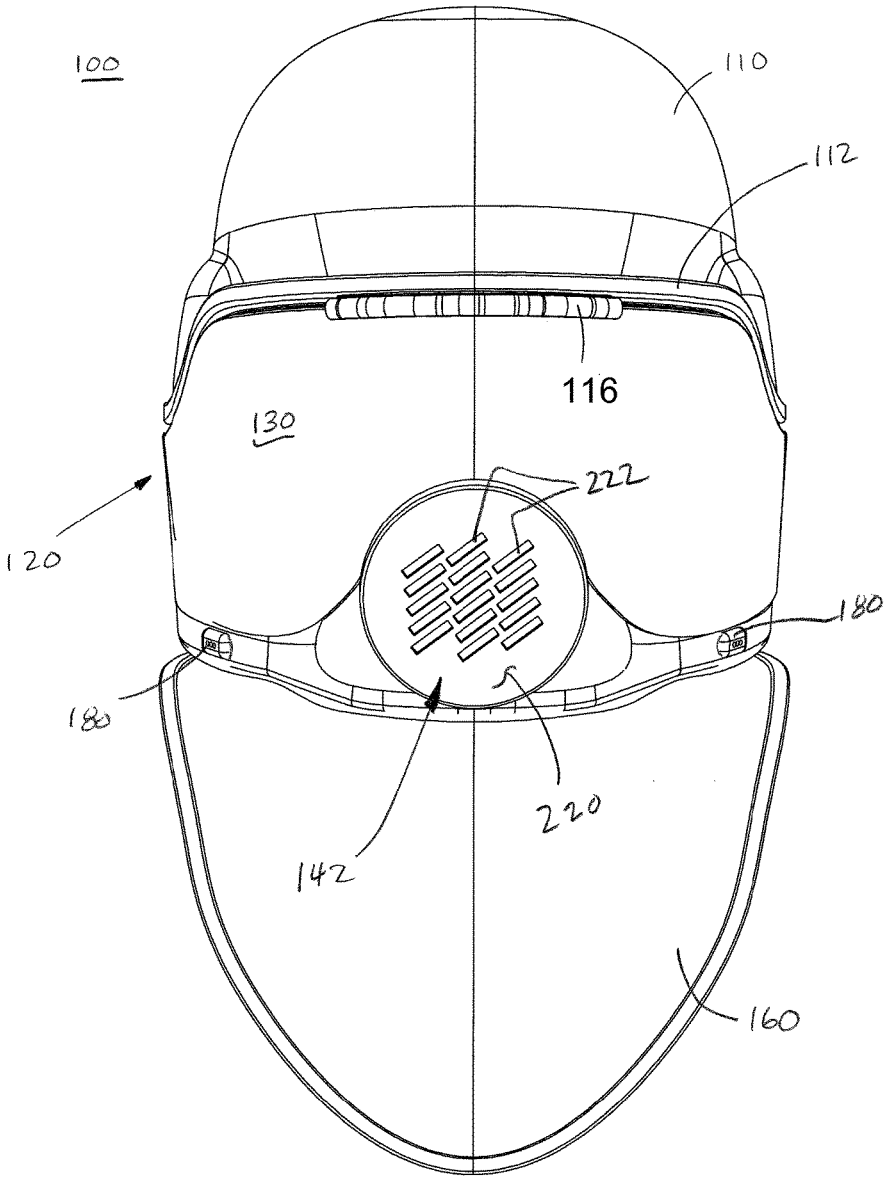
FIG. 1 is a front elevational view of an exemplary embodiment of the integrated helmet and respirator system herein.
Figure 2:
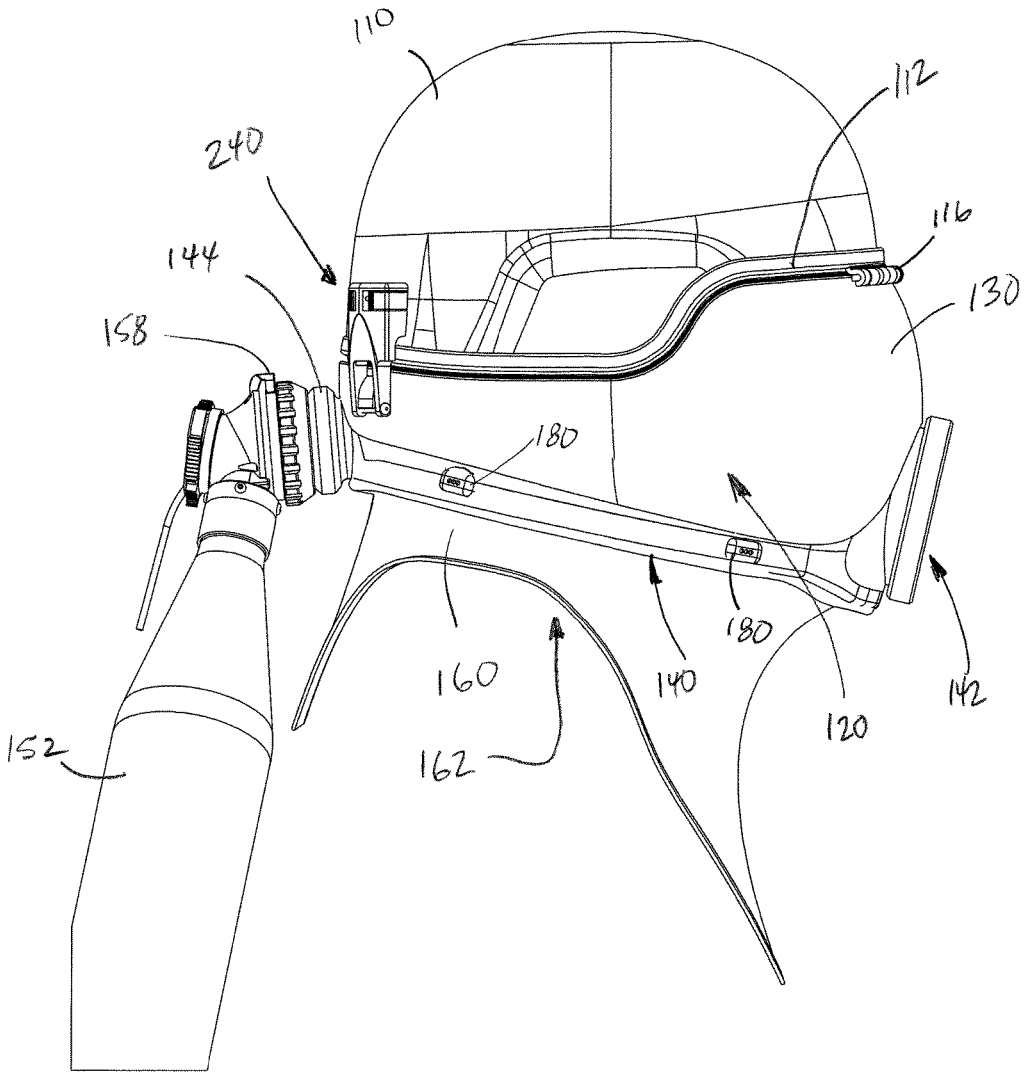
FIG. 2 is a right side elevational view of the integrated helmet and respirator system appearing in FIG. 1.
Figure 3:
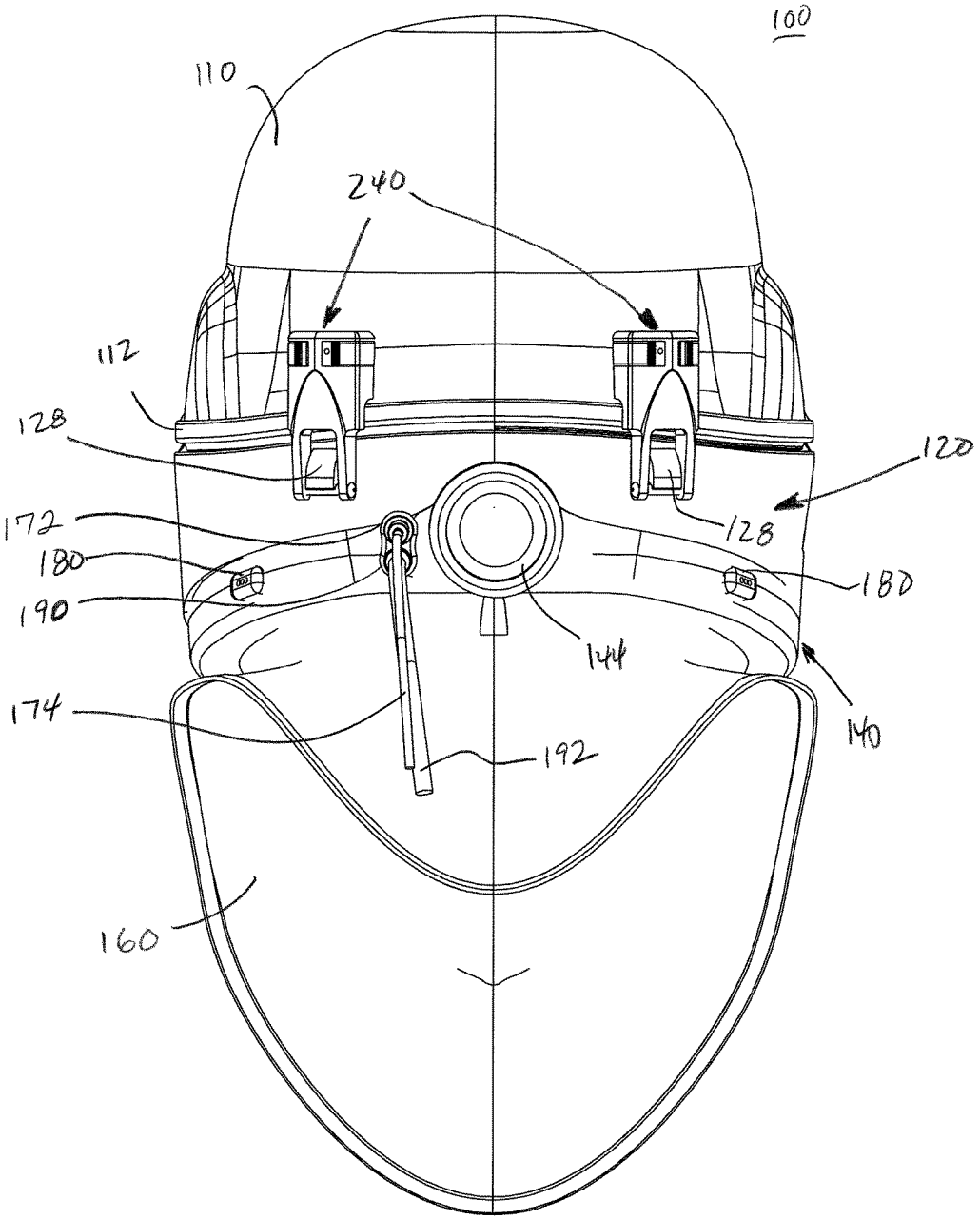
FIG. 3 is a rear elevational view of the integrated helmet and respirator system appearing in FIG. 1.
Figure 4:
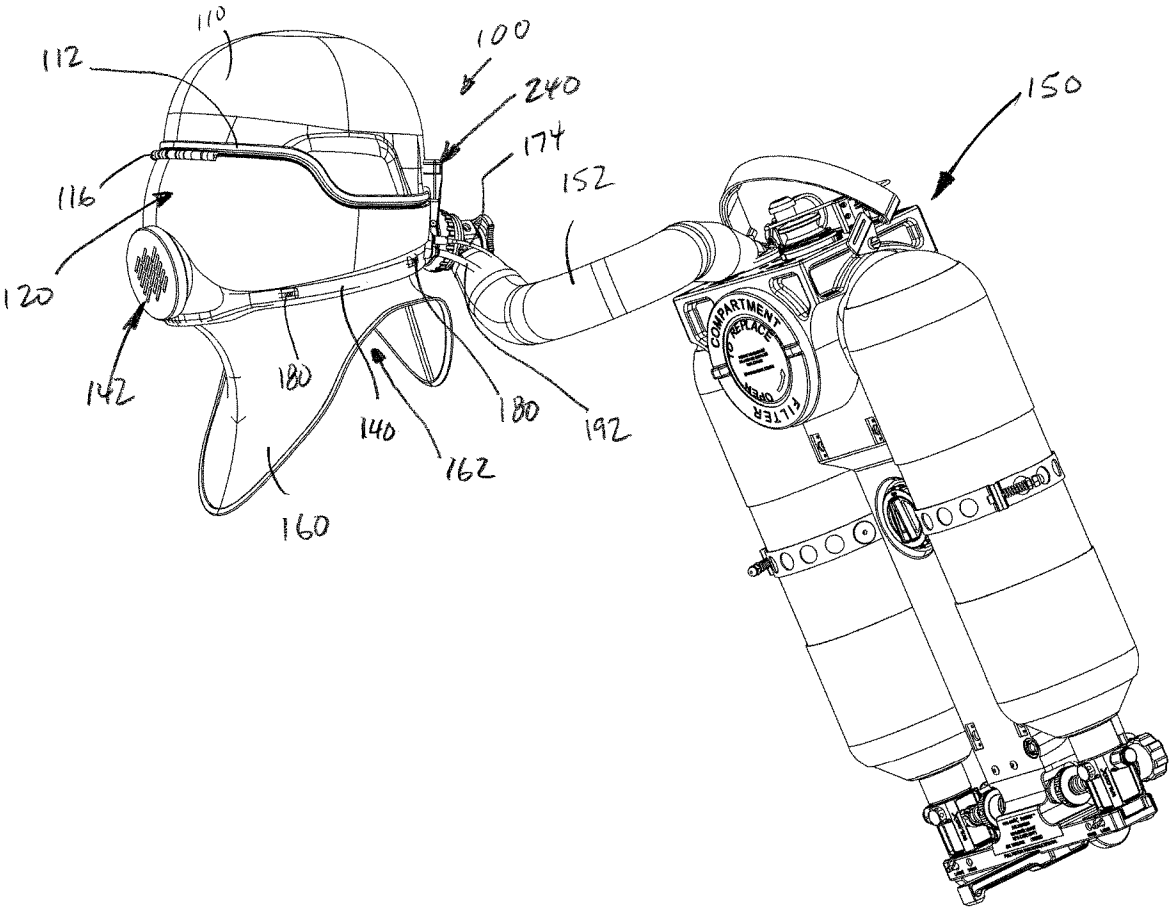
FIG. 4 is an isometric view taken of the integrated helmet and respirator system appearing in FIG. 1 with an exemplary combined self-contained breathing apparatus (SCBA)/powered air purifying respirator (PAPR).
Figure 5:
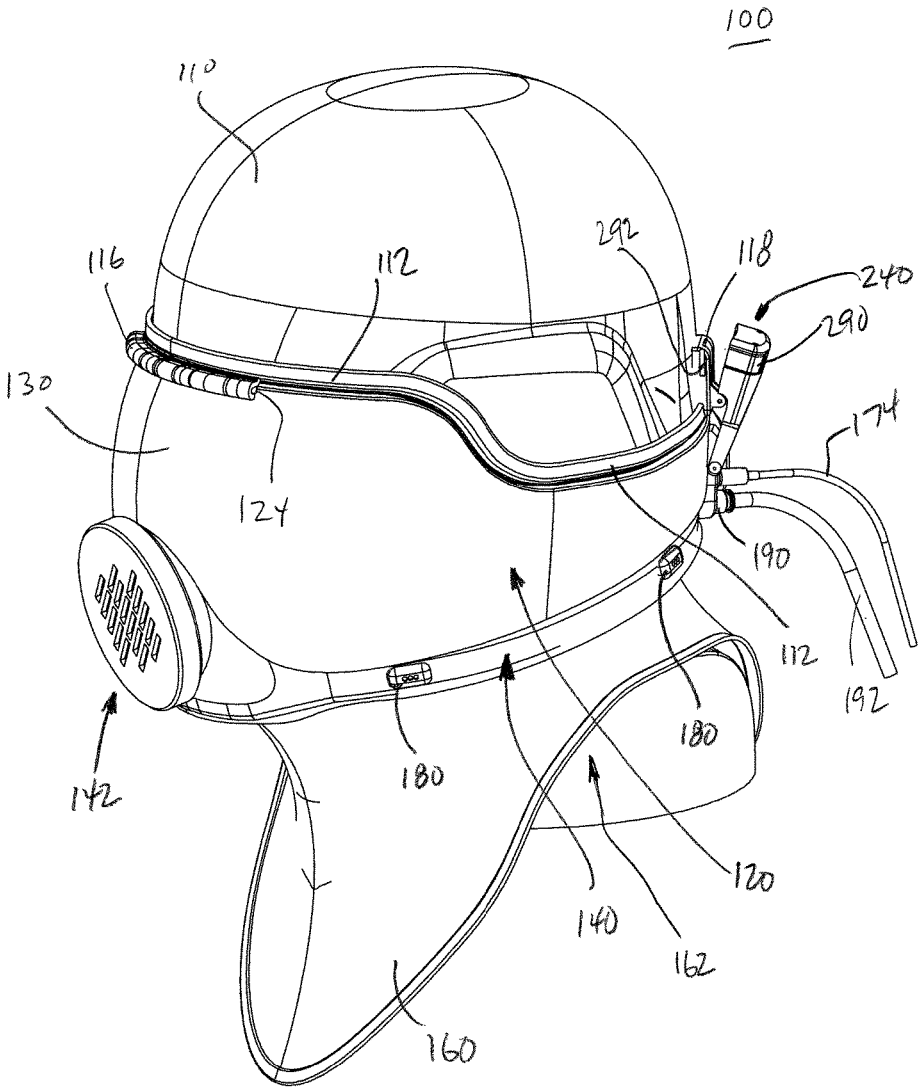
FIG. 5 is an isometric view of the integrated helmet and respirator system appearing in FIG. 1, taken generally from the front and left side.

As used herein, terms pertaining direction or orientation, such as upper, lower, front, rear, left, and right, and the like, are based on the perspective of a user wearing the system unless stated otherwise. Referring now to the drawings, an integral respirator or gas mask and helmet system 100 includes a helmet or shell portion 110, which is preferably a ballistic helmet, although non-ballistic protective helmets are also contemplated. The shell 110 may be formed, e.g., by laying up multiple plies of a ballistic material such as fiber reinforced composite material on a generally helmet-shaped pre-form. Such composite material may include fibers, e.g., polymer fibers such as aramid fibers (e.g., KEVLAR®) or other ballistic fiber impregnated with a polymer resin. Other ballistic and non-ballistic helmet shell types are also contemplated, including metal helmets, molded plastic helmets, etc.

Figure 6:
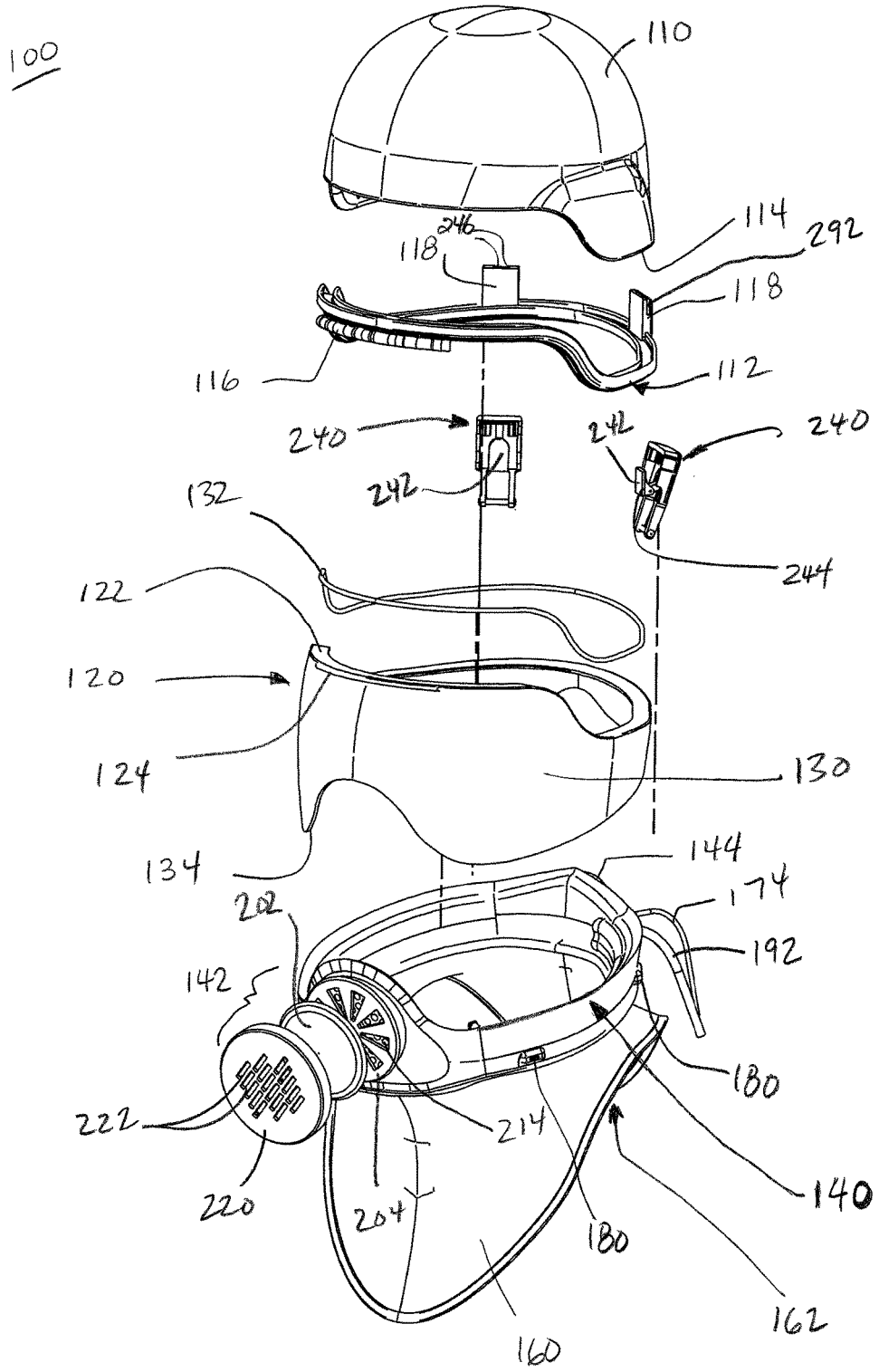
FIG. 6 is an exploded isometric view of the integrated helmet and respirator system appearing in FIG. 1.
Figure 7:
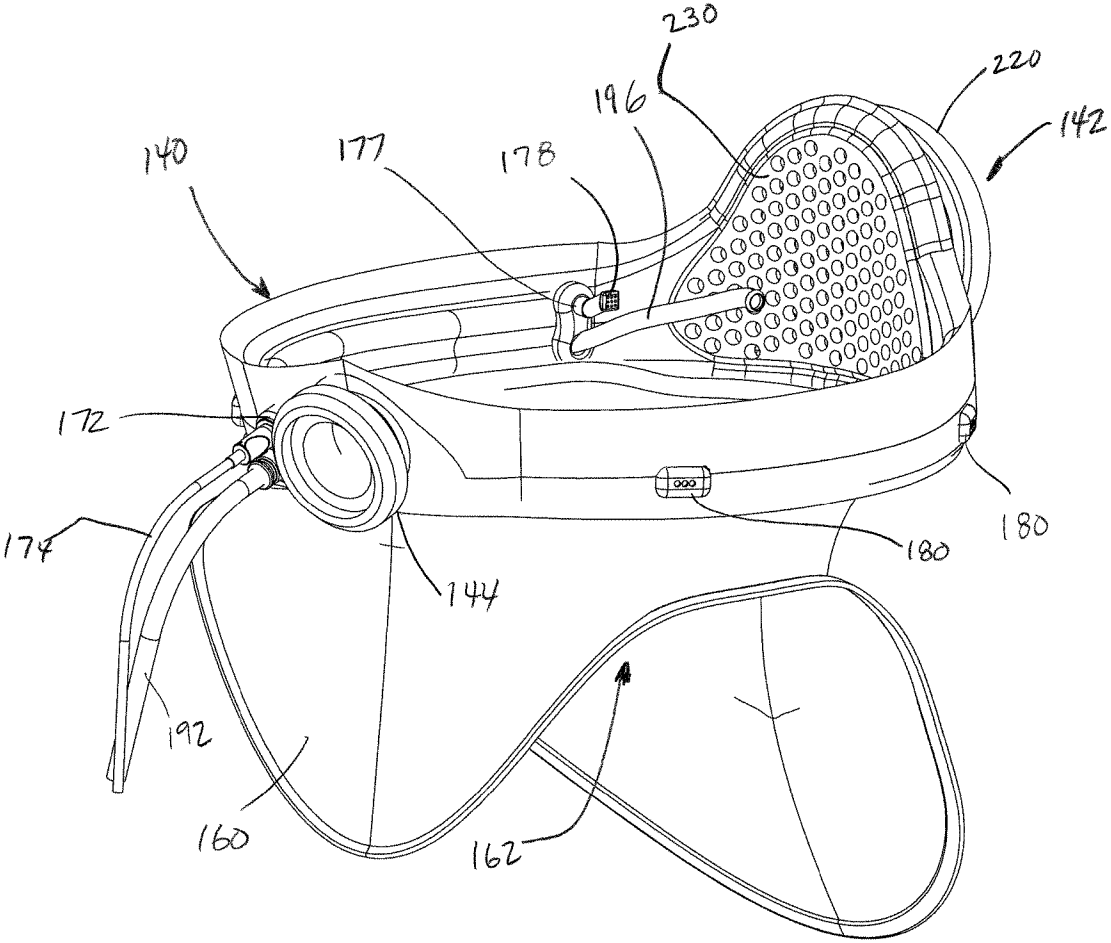
FIG. 7 is an enlarged, isometric view of the frame and neck dam portions taken generally from the rear and right side.
Figure 8:
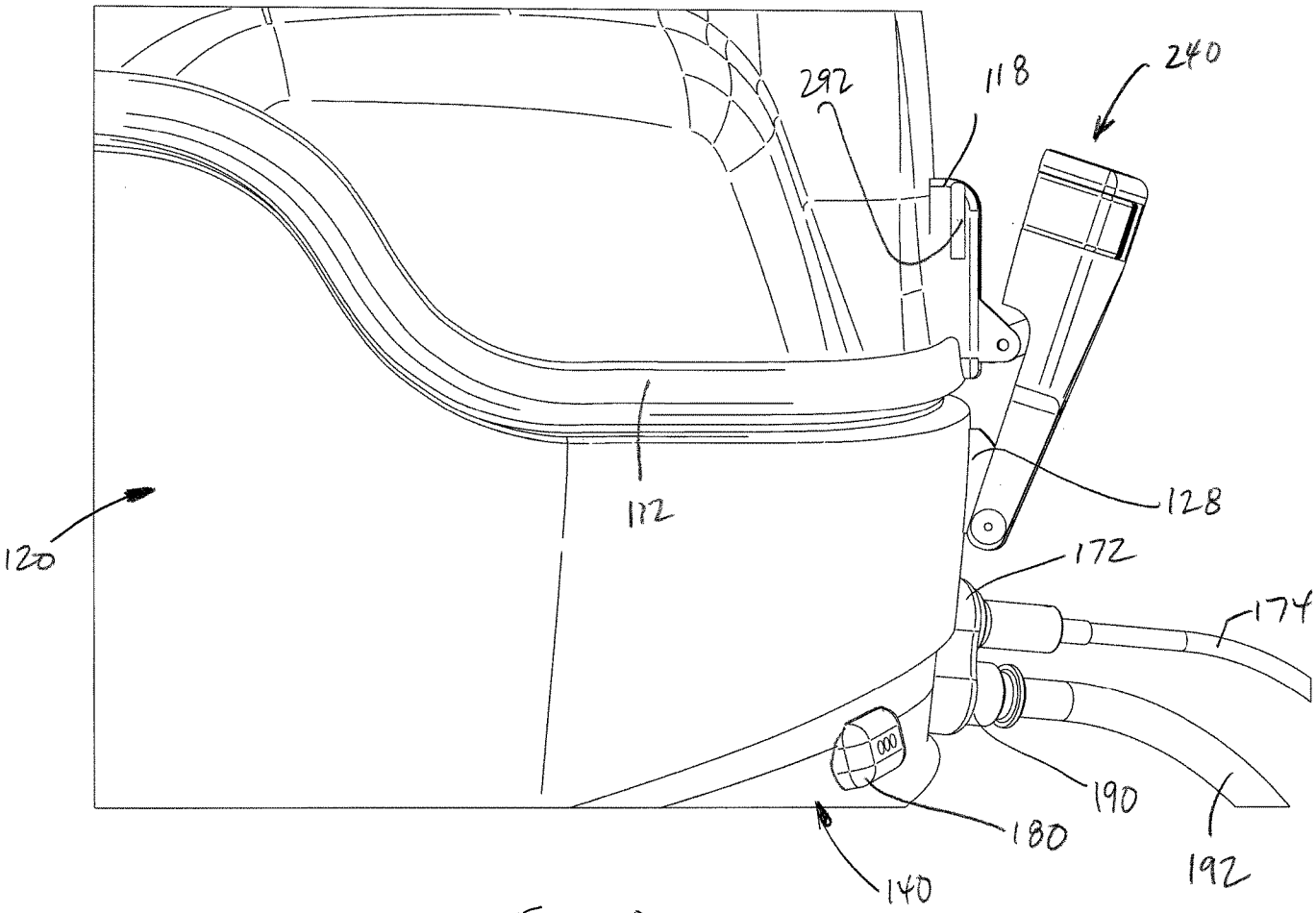
FIG. 8 is an enlarged, fragmentary view showing the compression latch assembly in the unlatched position.
Figure 9:
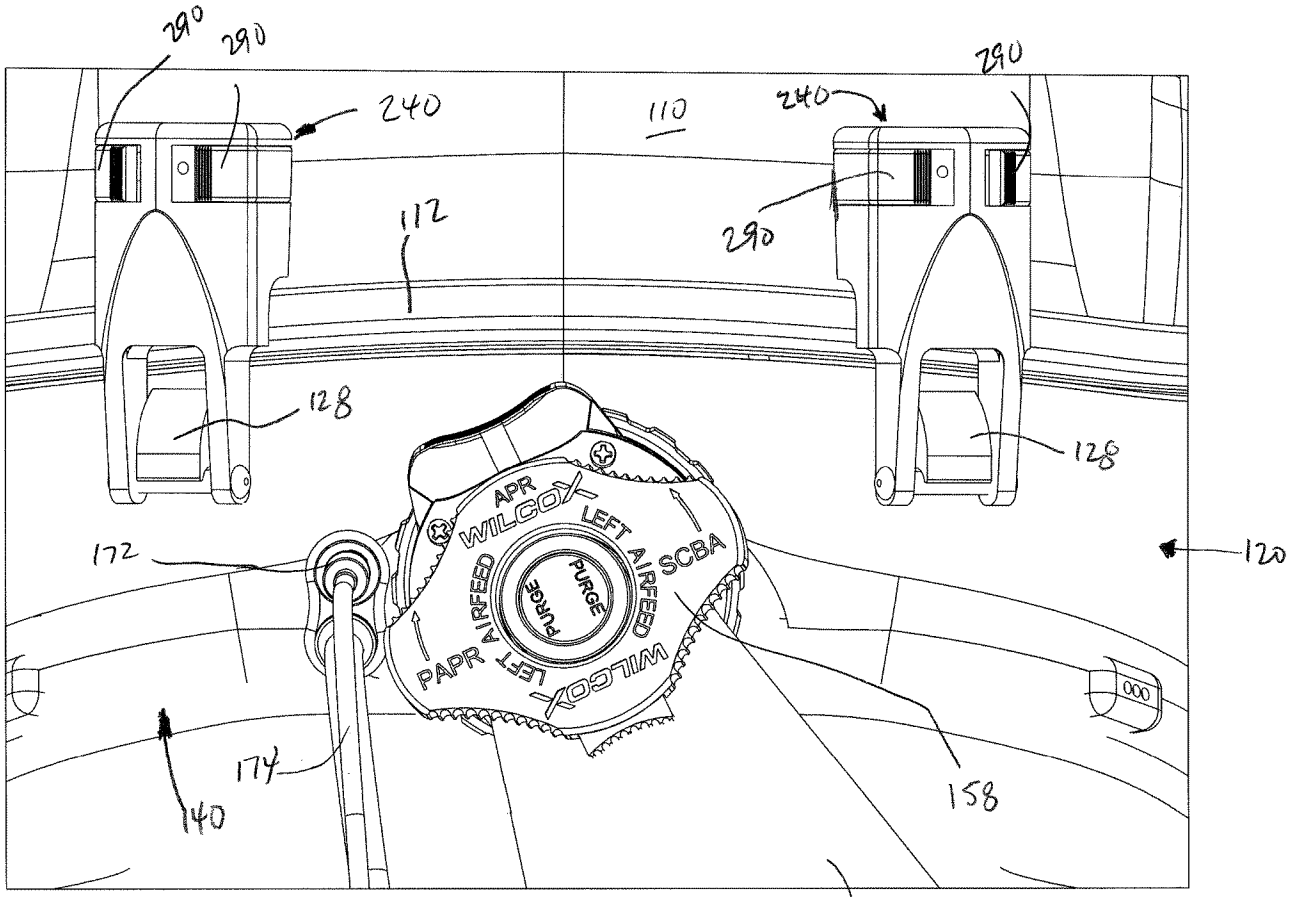
FIG. 9 is an enlarged, fragmentary view showing the attachment of a respirator breathing hose to the inlet port on the rear of the shroud.
Figure 10:
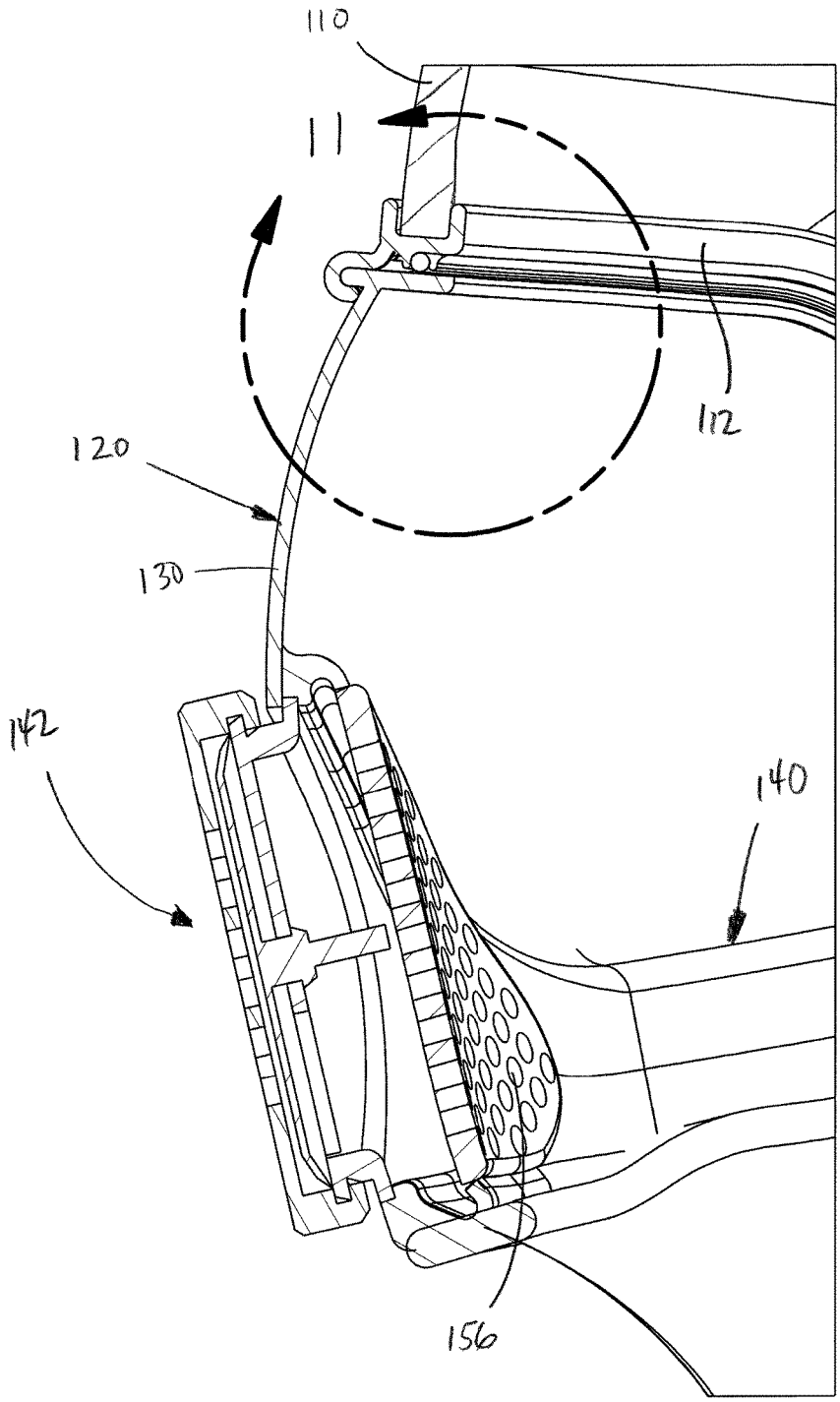
FIG. 10 is a fragmentary side cross-sectional view of the shroud front portion illustrating the exhaust valve and front fastener elements securing the front of the shroud to the front of the helmet edge trim.
Figure 11:
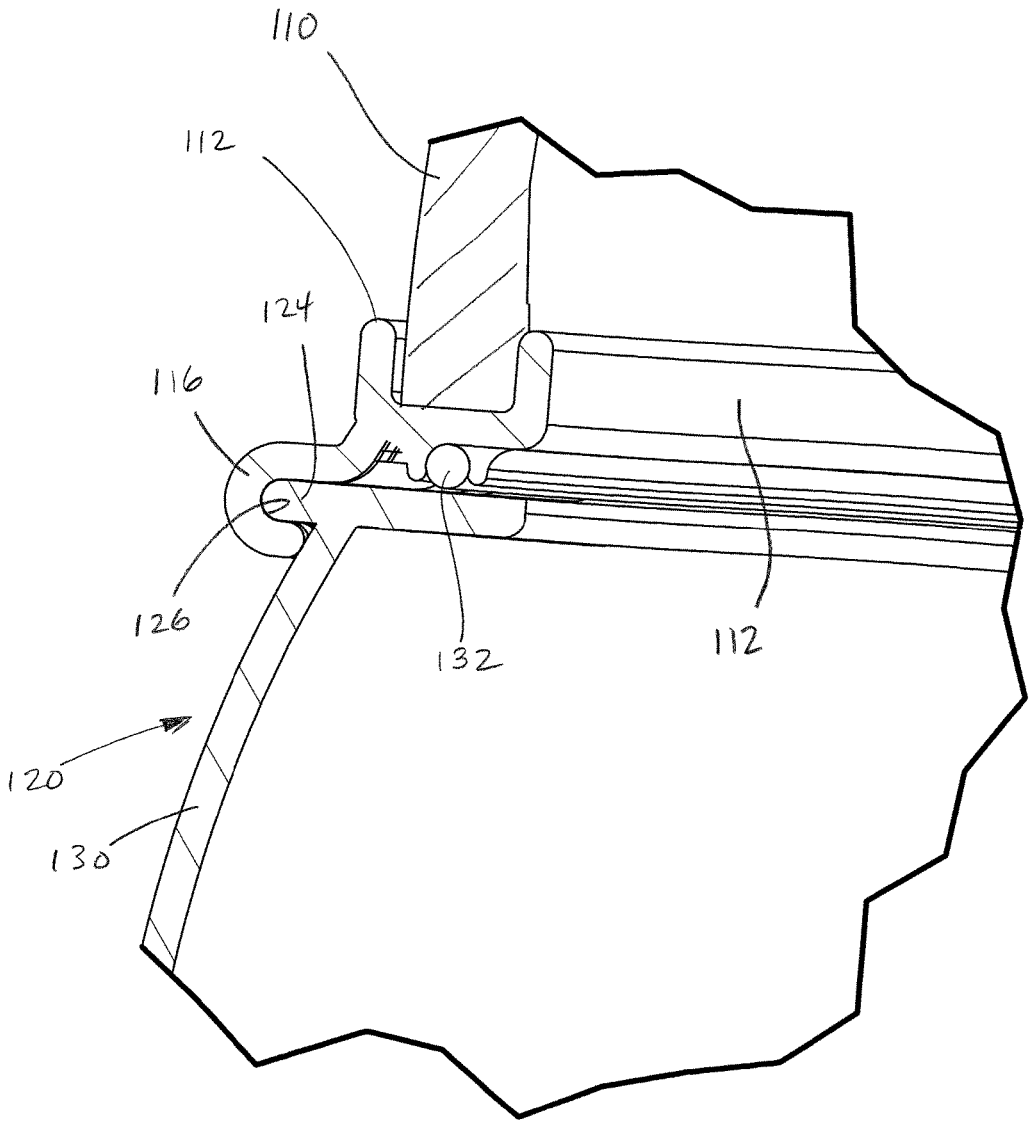
FIG. 11 is an enlarged view of the region 11 appearing in FIG. 10.
Figure 12:
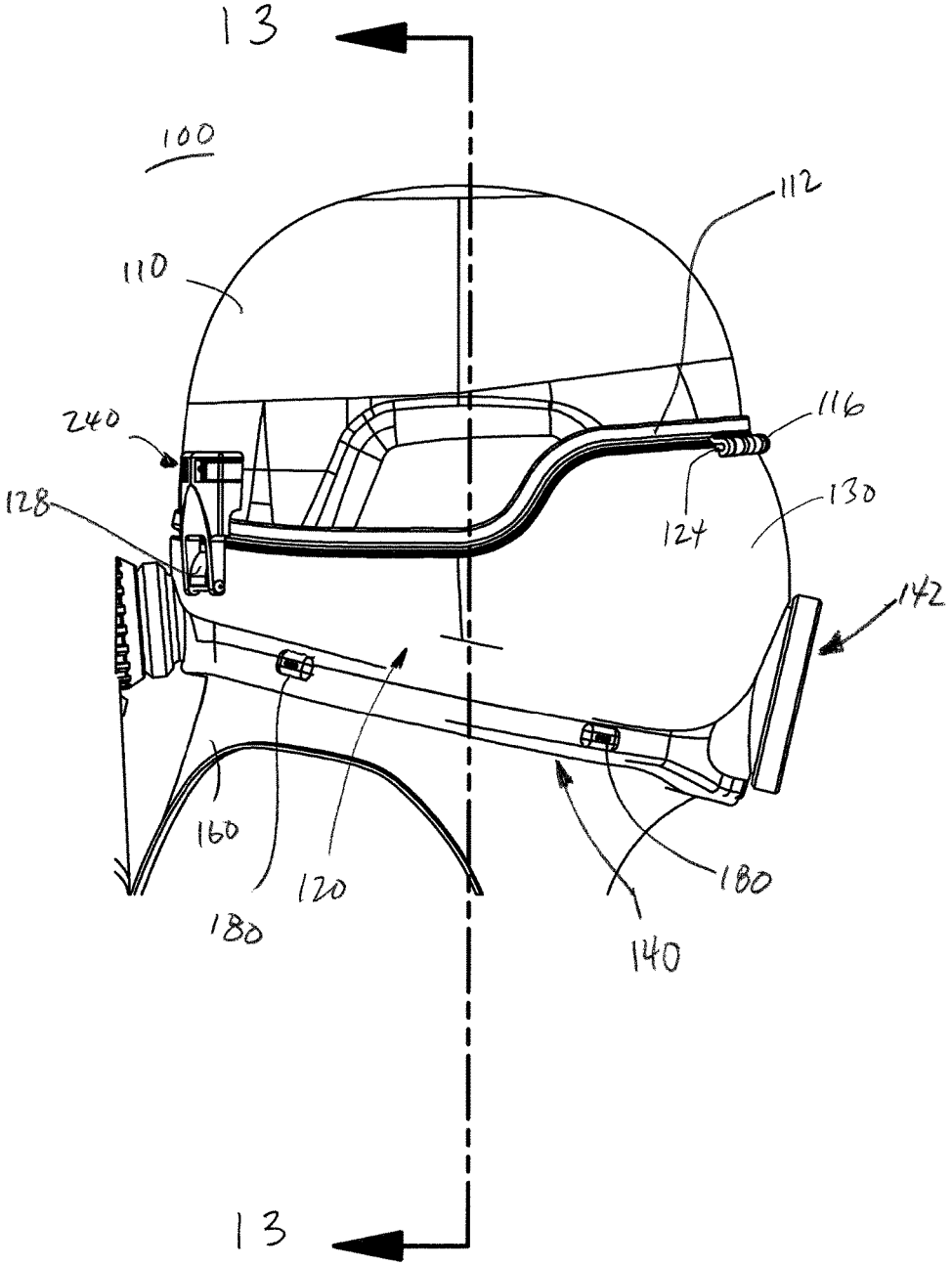
FIG. 12 is a right side elevational view of the integrated helmet and respirator system appearing in FIG. 1.

An edge trim 112 is secured, e.g., glued, to the unfinished brim 114 (see FIG. 6) of the helmet 110 and includes a front fastener 116 on the front portion of the edge trim 112 and a pair of latch brackets 118 on the rear portion of the edge trim. A face shield or shroud 120 is secured at its upper edge 122 to the edge trim 112. The shroud includes a tongue 124 on the front portion that is removably received within a groove or channel 126 defined by the front fastener 116 on the edge trim 112. The shroud 120 includes a pair of latch keepers or catches 128 on the rear portion of the shroud 120 in alignment with the latch brackets 118. Compression latch assemblies 240 are attached to the latch brackets 118 and removably engage the latch keepers 128, as described in greater detail below. The tongue 124 and/or catches 128 may be integrally formed, e.g., molded, with the shroud.

The front portion of the shroud 120 includes a visor or lens portion 130 which is transparent or otherwise allows transvisualization therethrough by the wearer. In addition to providing eye protection against environmental contamination and debris, the visor 130 may also filter optical radiation including ultraviolet (UV), infrared (IR) and/or visible light for eye protection, the filtered wavelengths being selected depending on the particular use. An O-ring or gasket 132 is disposed between the upper edge 122 of the shroud 120 and the edge trim 112 to provide a sealing interference therebetween.

The lower edge 134 (see FIG. 6) of the shroud 120 is attached to an annular frame 140, e.g., via gluing or an adhesive. The frame 140 includes an exhaust port 142 on the front portion and a respirator port 144 on the rear portion. In the preferred embodiment, the respirator port 144 is configured to removably attach to a breathing hose 152 of a breathing system 150, which may be a self-contained breathing apparatus (SCBA), powered air-purifying respirator (PAPR), or a combined SCBA and PAPR device. The breathing hose 152 includes a connector 158 for removable attachment of the breathing hose to the respirator port 144. It will be recognized, however, that in alternative embodiments, the respirator port 144 could be configured to be removably attached to a breathing filter or canister, wherein negative pressure produced by inhalation is used to draw air through the filter. The breathing apparatus may be a combined SCBA/PAPR life support system as described in commonly owned U.S. Pat. No. 7,647,927, which is incorporated herein by reference in its entirety.

Left and right air passageways 154 are formed within the frame 140 and extend from the respirator port 144, which defines an inlet to the passageways 154, to outlets 156 on the interior side of the frame 140 to deliver air or other breathable gas to the user.

A neck seal or dam 160 extends downward from the frame 140 and may be integrally formed therewith or separately attached. The neck seal 140 defines a central passageway or opening 162 for the user's head to enter the helmet and preferably forms a substantially fluid tight seal between the neck seal 160 and the user's neck. Additionally or alternatively, the neck dam is configured to provide a fluid tight seal between the neck seal 160 and a protective outer garment worn by the user (not shown). The neck seal 160 may be formed of a polymer material and preferably is formed of a chemically resistant or hardened material.

Figure 13:
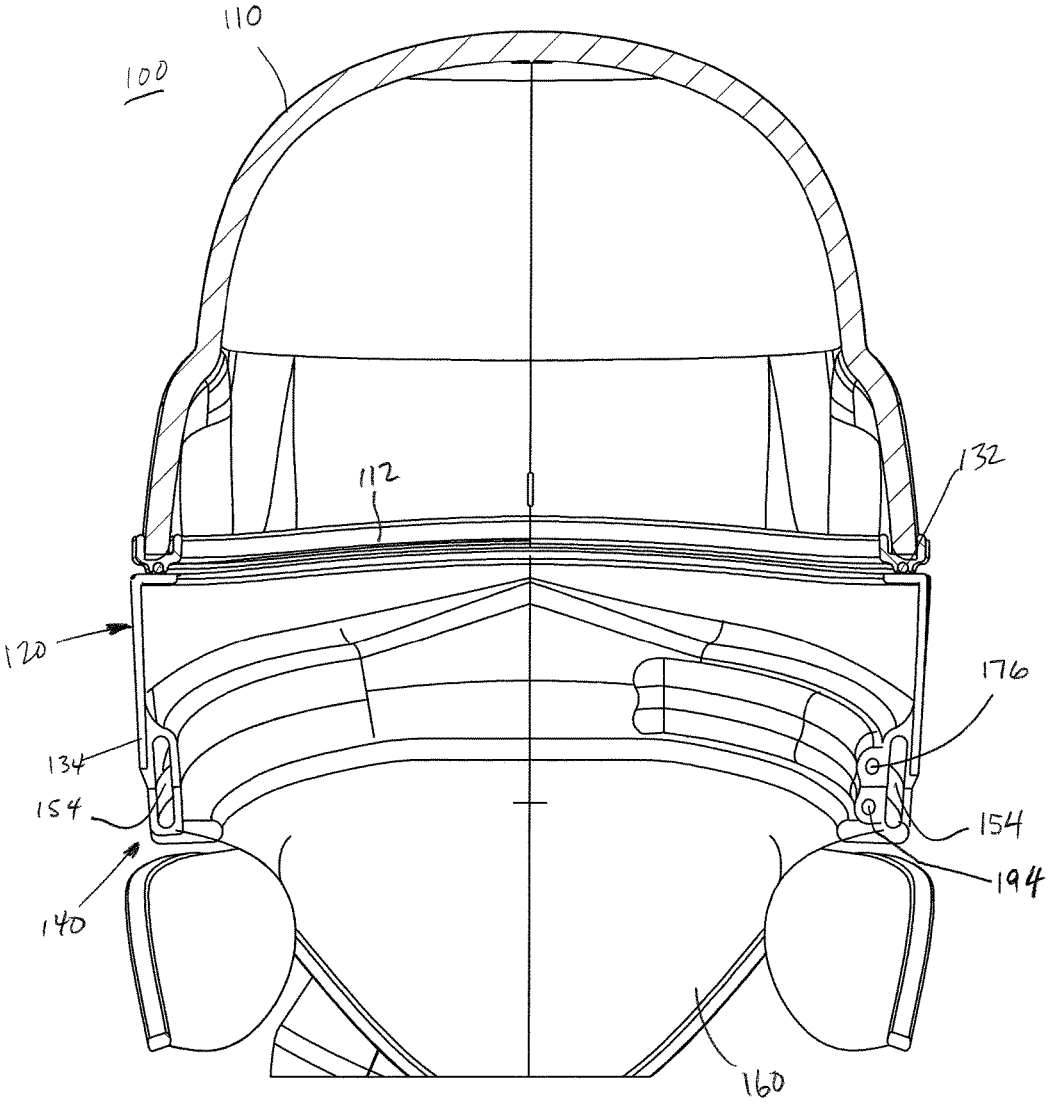
FIG. 13 is a cross-sectional view taken along the lines 13-13 appearing in FIG. 12.
Figure 14:
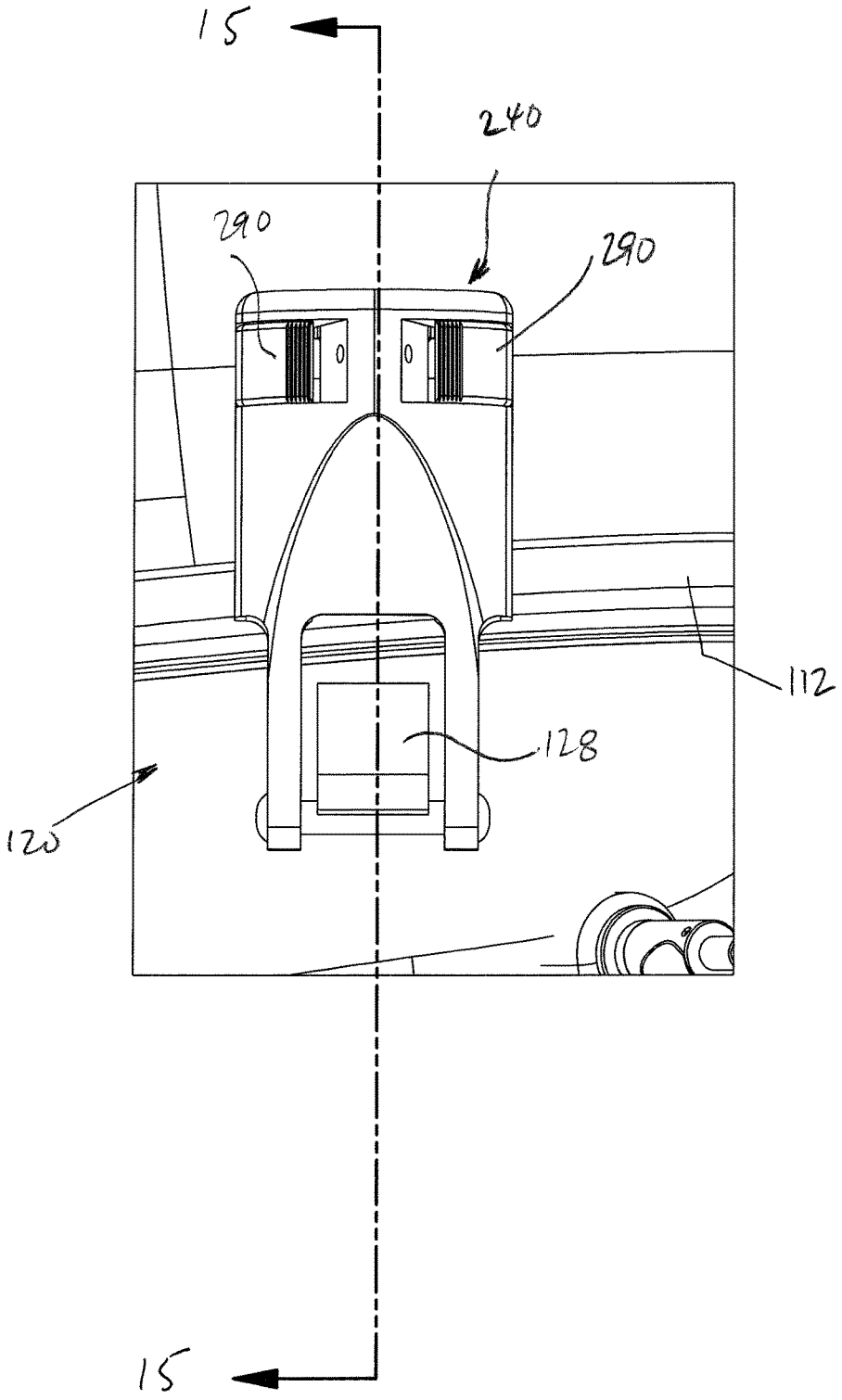
FIG. 14 is an enlarged fragmentary view illustrating a compression latch assembly in the closed or latched position.

The frame 140 includes an electrical connector 172 for connection to a communication system (not shown) such as a two-way radio which may be integrated with the life support system 150. The connector 172 allows a cable connection 174 between the helmet system herein and the communication system. As best seen in FIG. 13, the frame 140 includes an internal passageway 176 for routing communication wiring 177 from the connector 172. The wiring 177 in the passageway 176 may be electrically coupled to a microphone 178 disposed within the interior compartment defined by the unit 100 for transmitting the user's speech via the radio or communication system. The system 100 may also include an audio amplifier and one or more audio speakers (not shown) positioned within the helmet for audibly outputting audio transmissions received by the communication system.

One or more microphones 180 may be positioned on the exterior of the frame 140 and connected to an audio amplifier and one more audio speakers within the helmet to provide the user with greater situational awareness by picking up external or ambient sounds and generating an audible reproduction of the picked up sounds within the helmet.

A connector 190 is also provided for delivery of water or other liquid. A feed tube 192 has a first end adapted to be coupled to a source of water of other liquid, such as a hydration bladder or other reservoir (not shown) and a second end coupled to the connector 190. A passageway 194 is formed within the frame 140 to define a fluid passageway between the feed tube 192 and a drinking tube or straw 196 within the interior compartment defined by the unit 100 and proximate the user's mouth, allowing the user to ingest water or other liquid, e.g., thereby allowing the user to ingest hydration and/or calories without the need to remove the helmet system 100.

The exhalation port 142 includes a one-way valve defined by a flexible valve diaphragm 202 and a perforated valve seat member 204. The valve seat member 204 is mounted in a front opening in the frame 140 in general alignment with the mouth of the user. The diaphragm 202 includes a peripheral sealing edge 206 which bears against the exterior surface of the valve seat member 204 adjacent the periphery of the valve seat 204. The diaphragm 202 may be formed of rubber or other deformable, resilient natural or synthetic polymer material. The diaphragm 202 is secured to the valve seat member 204 via a central post 208 extending from the inward facing side of the diaphragm 202, which extends through a central opening 210 in the valve seat member 204. An enlarged diameter head 212 on the post 208 anchors the diaphragm and prevents the diaphragm 202 from disengaging with the valve seat member 204. Relative pressure changes on either side of the diaphragm 202 deform the diaphragm, allowing passage of air in one direction only.

The perforated valve seat member 204 includes perforations 214 configured to allow air to pass therethrough from the interior of the mask system 100 to the interior side of the diaphragm 202. In operation, increased pressure within the helmet, e.g., as a result the exhalation pressure of a user wearing the unit, causes the sealing edge 206 to move away from the valve seat member thereby allowing exhalation gases to exit through the port 142. Similarly, decreased pressure within the helmet, on the on the interior side of the diaphragm 202, e.g., as a result the negative inhalation pressure of a user wearing the unit, draws the diaphragm 202 toward the valve seat member 204, thereby increasing the sealing pressure between the sealing edge 206 and the valve seat 204, thereby preventing external or ambient air from entering the interior of the mask system 100 through the port 142.

An outer perforated grill 220 includes perforations 222 and is received over the diaphragm 202 to keep dust and debris away from the valve members 202, 204. The grill 220 includes a channel or groove 224 receiving a peripheral flange 226 on the valve seat member 204. An inner perforated plate or panel 230 includes the perforations 156 is disposed within the frame 140 between the user's mouth and the valve seat member 204. In addition to allowing exhalation gases to exit the interior of the mask system 100, the perforations in the inner perforated panel 230, valve seat member 204, and outer grill 220 cooperate to allow sound or speech made by the user to be transmitted through the port 142.

As best seen in FIGS. 14-17, the latch assemblies 240 each include a latch base portion 242 which engages the latch bracket 118. For example, the base portion 242 may include fins 244 which engage complimentary channels 246 in the latch brackets 118. A first pivot pin 248 provides a pivot connection between a protruding arm 258 of the base portion 242 and a first end of a pivot or toggle link 250. A second pivot pin 252 provides a pivot connection between a second end of the toggle link 250 to a plunger 254. The plunger 254 is slidably received within a channel or groove 256 formed within a latch lever 260.

The latch lever 260 includes a latch bar 262 which extends between lever legs 264 and which is removably received within a channel 266 on the lower side of the keeper 128. In operation, to fasten the latch assembly 240, the lever 260 is first moved to an open or unlatched position, wherein the link member 250 is pivoted away from the base portion about the pivot pin 248. The latch bar 262 is then placed within the channel 266 and the lever 260 is pivoted about the latch bar 262 toward the latch bracket 118.

Figure 15:
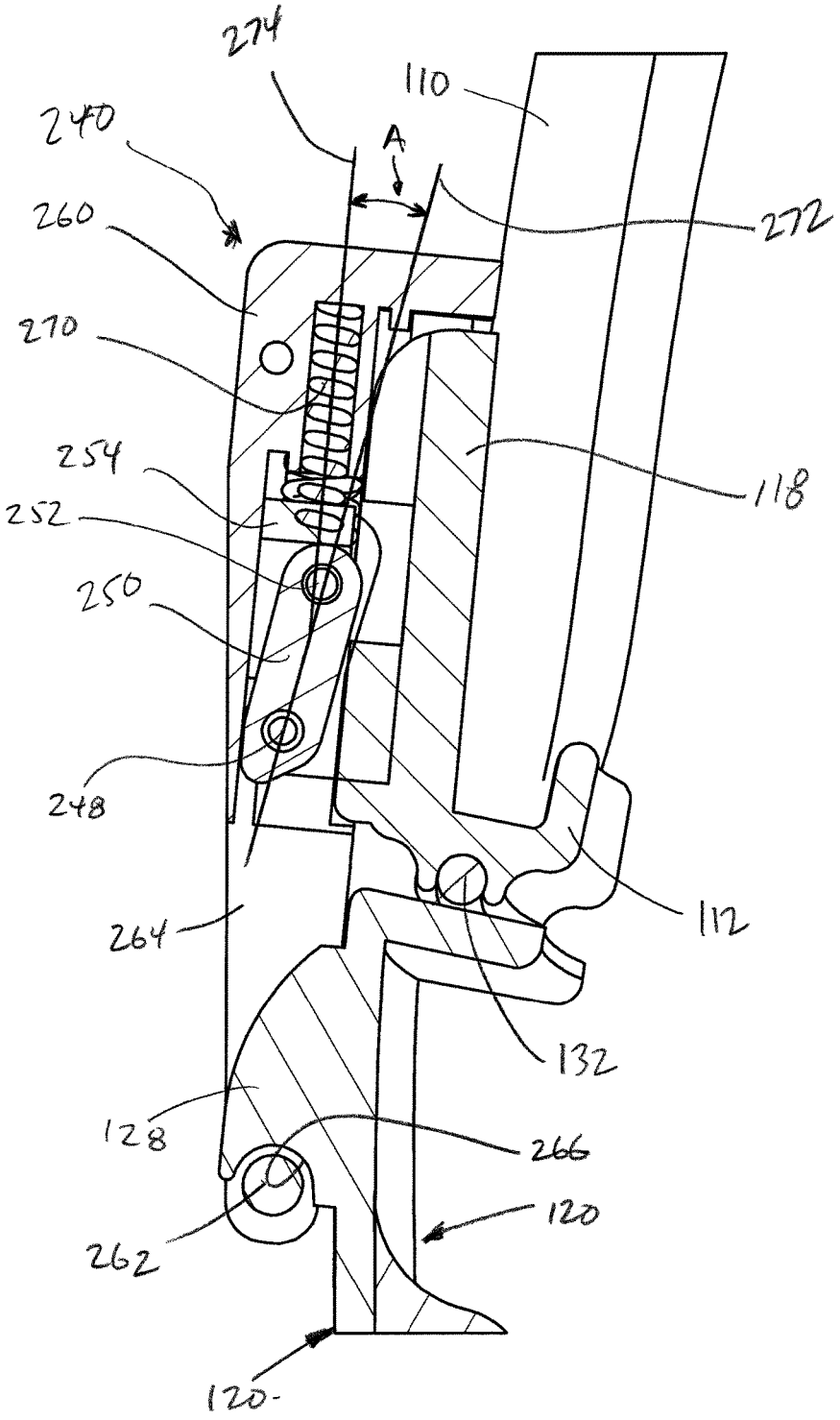
FIG. 15 is a cross-sectional view taken along the lines 15-15 appearing in FIG. 14.
Figure 16:
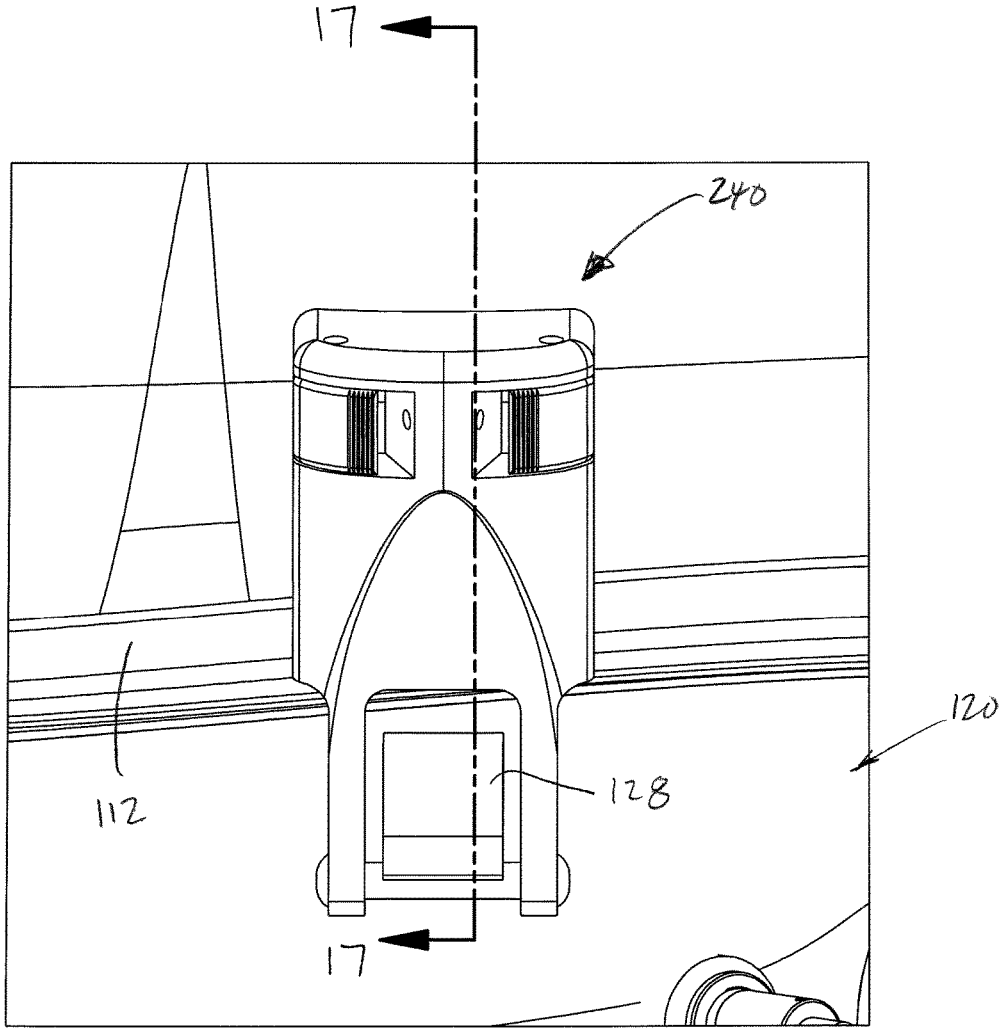
FIG. 16 is an enlarged fragmentary view illustrating a compression latch assembly in the open or unlatched position.
Figure 17:
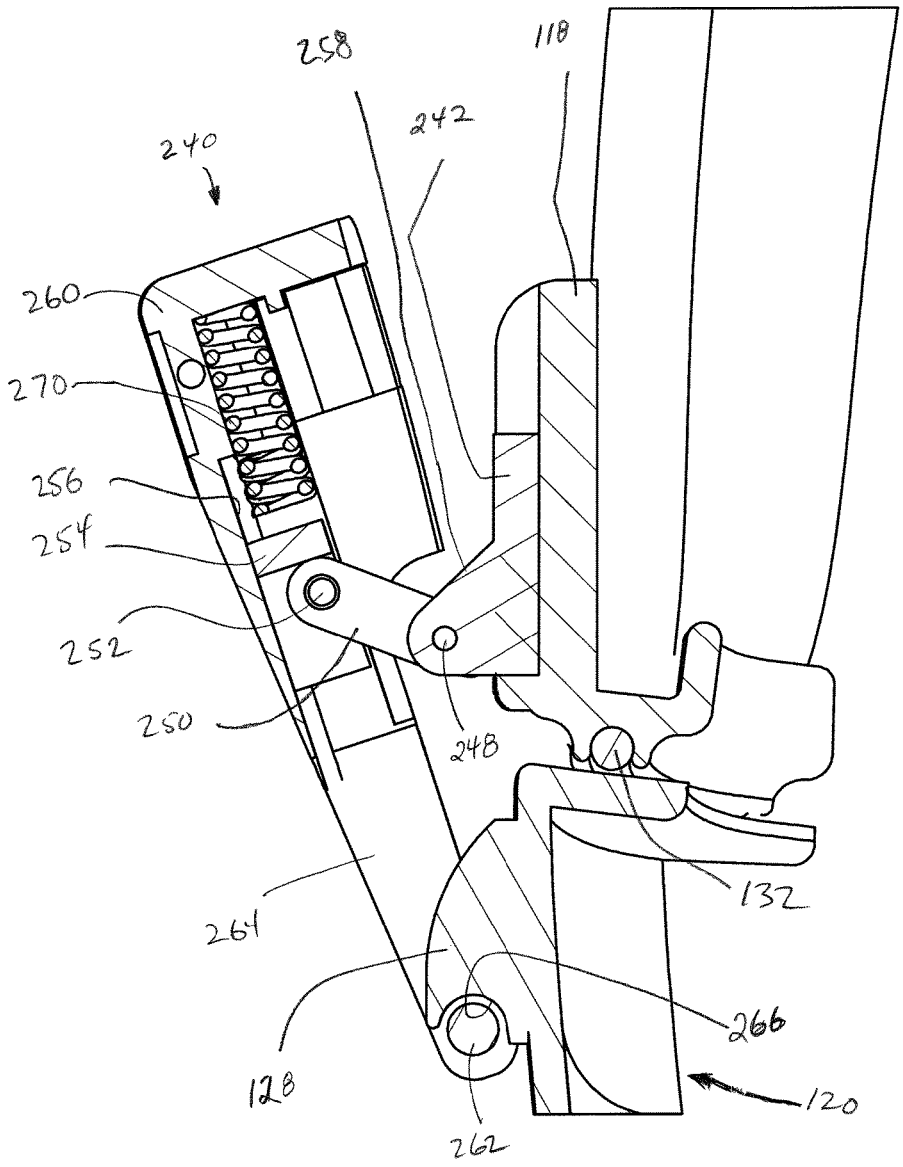
FIG. 17 is a cross-sectional view taken along the lines 17-17 appearing in FIG. 16.
Figure 18:
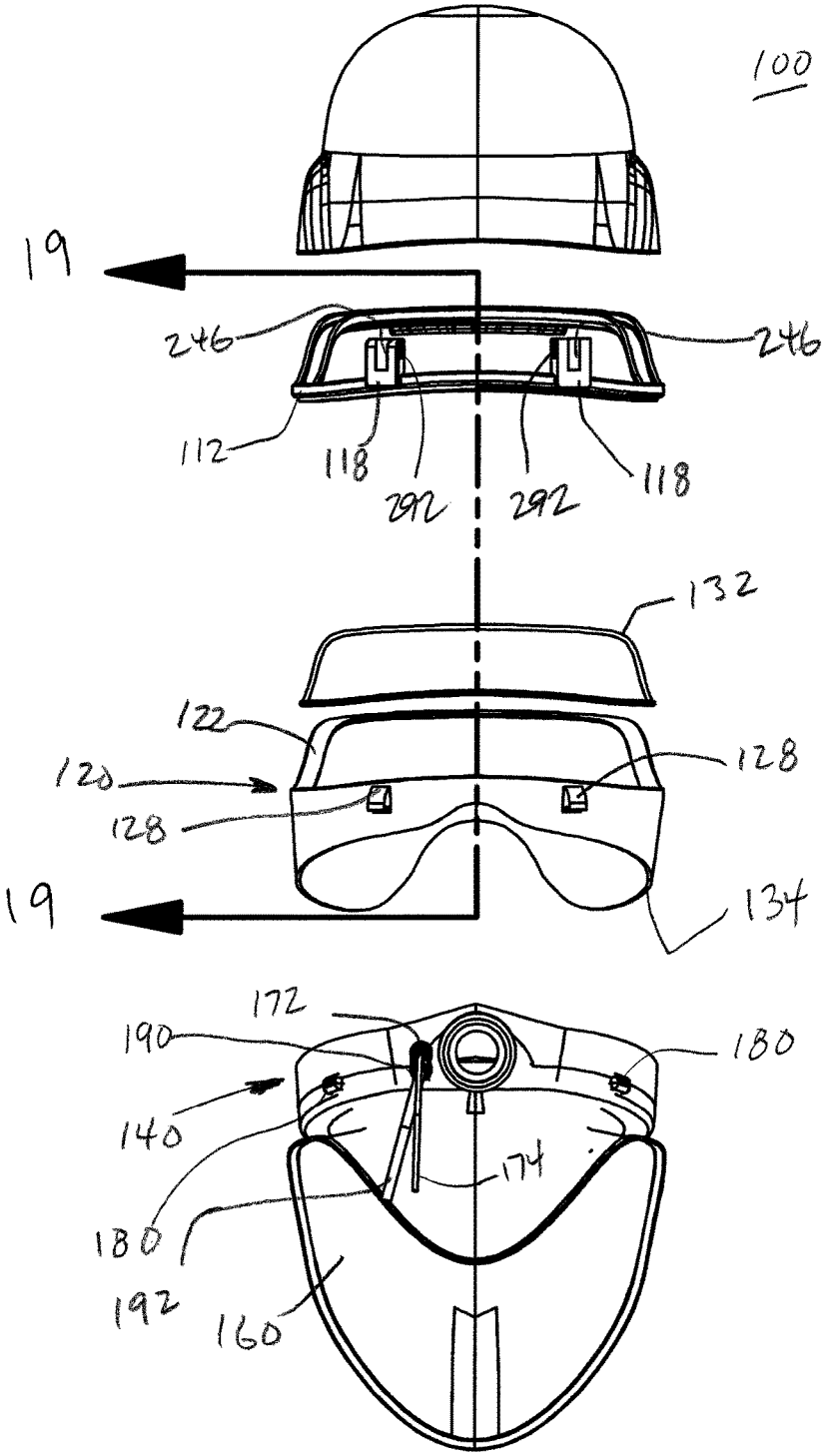
FIG. 18 is an exploded rear elevational view of the integrated helmet and respirator system appearing in FIG. 1.
Figure 19:
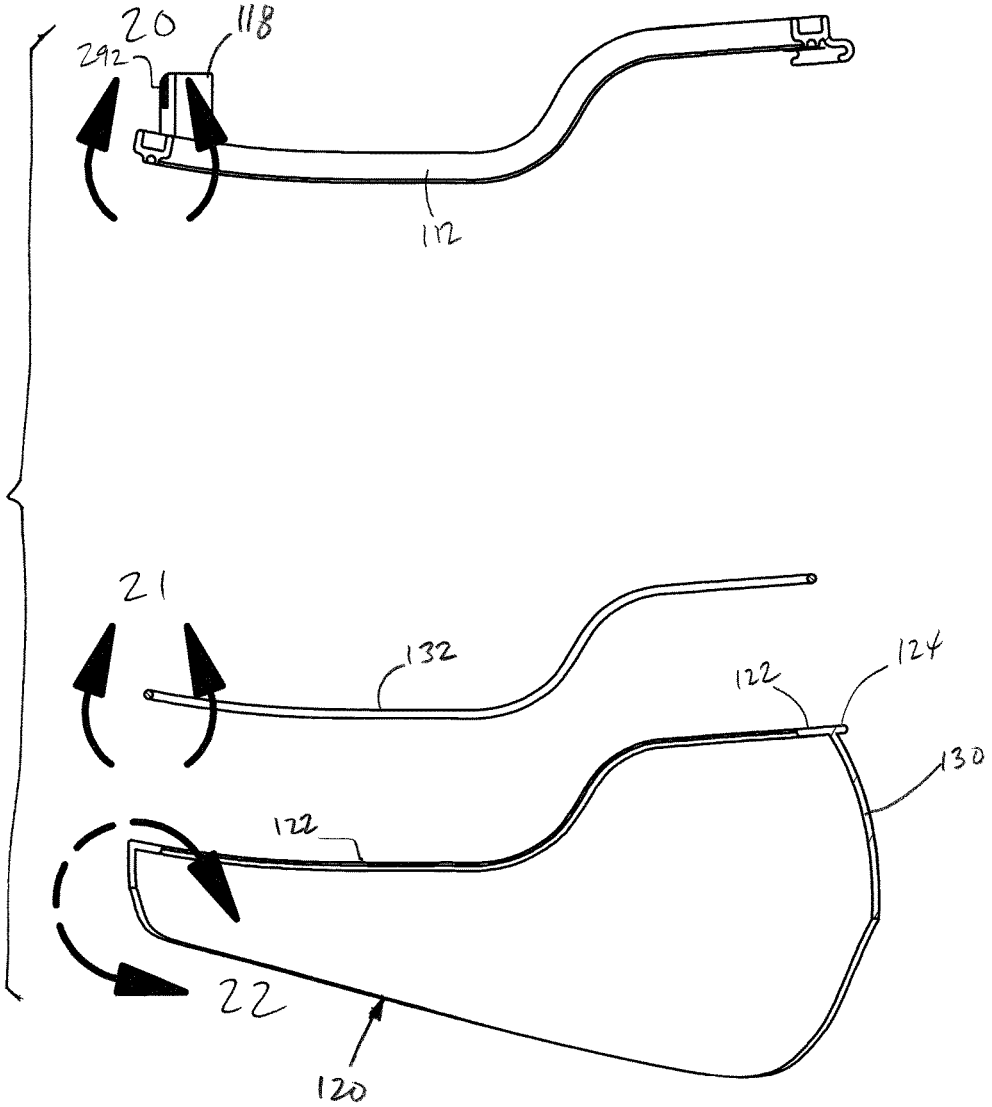
FIG. 19 is a cross-sectional view taken along the lines 19-19 appearing in FIG. 16.
Figure 20:
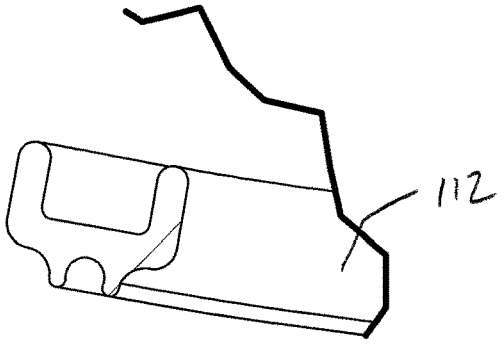
FIG. 20 is an enlarged view of the region 20 appearing in FIG. 19.
Figure 21:
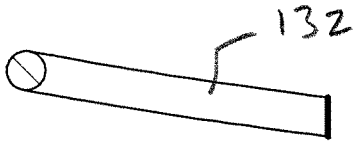
FIG. 21 is an enlarged view of the region 21 appearing in FIG. 19.
Figure 22:
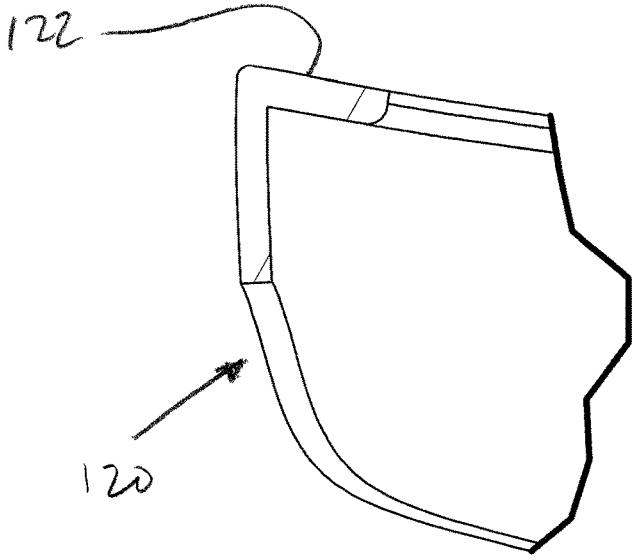
FIG. 22 is an enlarged view of the region 22 appearing in FIG. 19.
Figure 23:
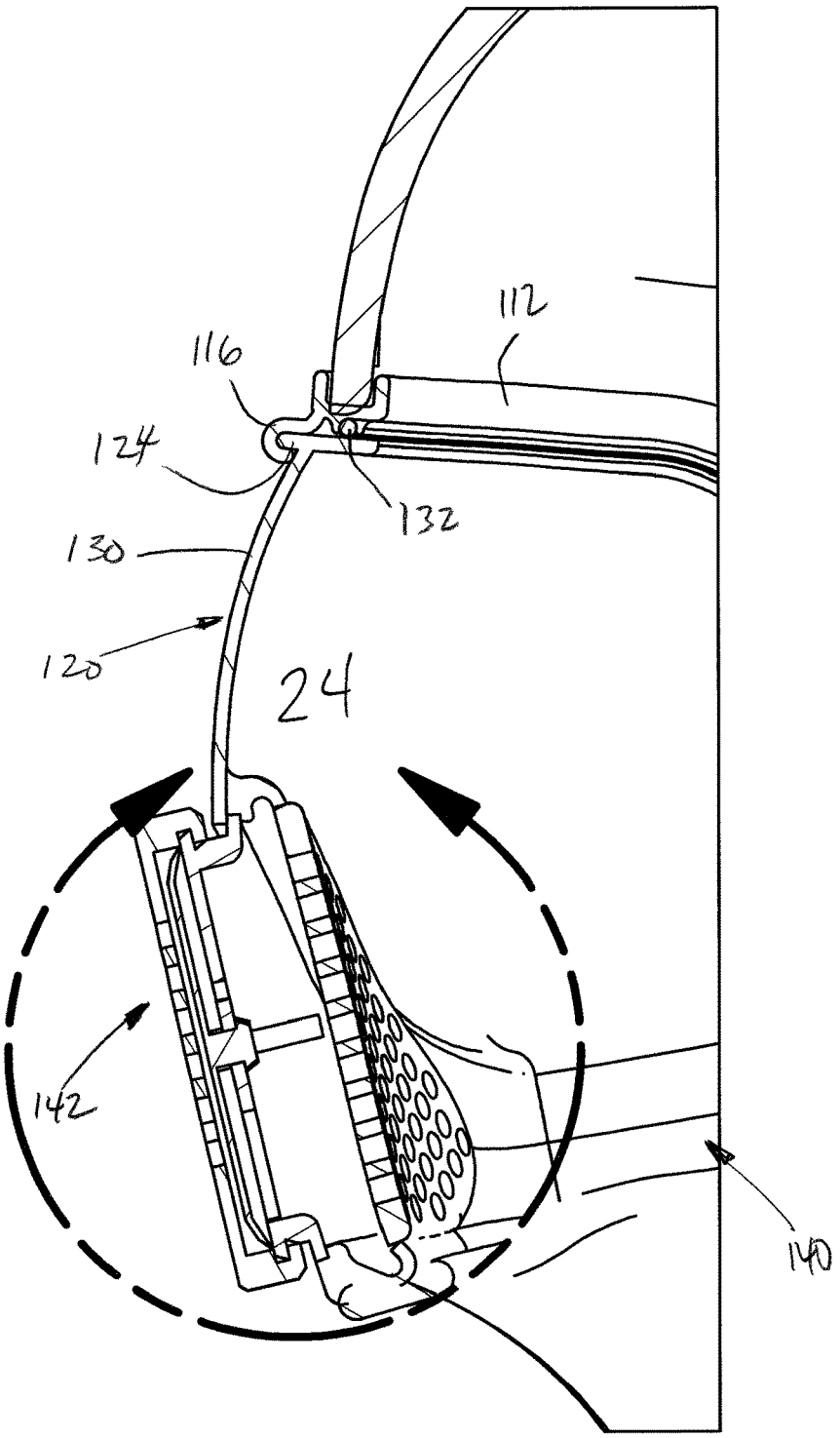
FIG. 23 is a fragmentary side cross-sectional view of the shroud and helmet front portion.
Figure 24:
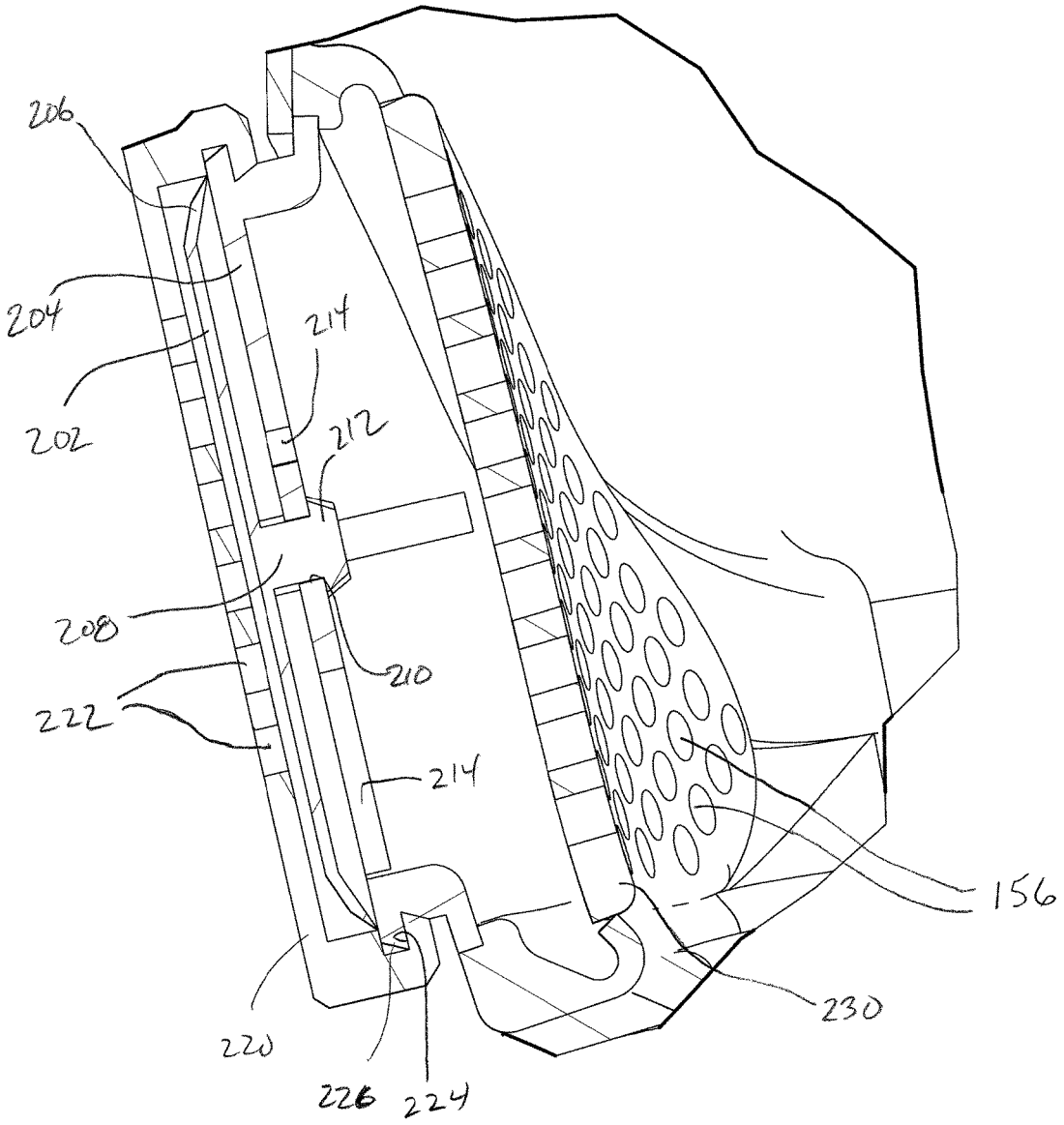
FIG. 24 is an enlarged view of the region 24 appearing in FIG. 23.

As the lever 260 is pivoted toward the latch bracket 118, the toggle link 250 pivots about the axis 248 and the axis 252, which causes the plunger 254 to move upward until it contacts and begins to compress a coil spring 270 or other resilient member seated within the lever 260. The lever 260 is pivoted about the bar 262 until the lever 260 reaches a latched position wherein the lever engages the latch bracket 118. As best seen in FIG. 15, when the lever 260 reaches the latched position, the link 250 is pivoted about the pin 262 to an overcenter position, wherein the long axis 272 of the toggle link 250 forms an angle A with respect to the spring axis 274. The plunger 254 bears against the upper end of the toggle link 250, exerting a force in the direction of the axis 274 to retain the lever 260 in the latched position.

The length of the toggle link 250 is selected so as to cause a drawing up of the bar 262 within the against the channel 266 to cause the shroud member 120 and the helmet edge trim member 112 to be drawn together. In this manner, a clamping pressure is applied between the upper edge 122 of the shroud and the O-ring or gasket 132 to provide a sealing engagement therebetween. The lever 260 may additionally contain locking members 290, which can be manually actuated to selectively engage the bracket 118 to prevent inadvertent movement of the lever 260 from the latched position to the unlatched position when the locking members 290 are moved to the locked position. For example, the locking members 290 may include a protrusion which selectively engages and disengages complementary receptacles 292 on the brackets 118.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. An integrated helmet and respirator system comprising:

a shell defining a helmet portion, the helmet portion being bounded by a peripheral edge;

an annular shroud having an upper edge and a lower edge, the upper edge removably attached to the peripheral edge of the helmet portion and the lower edge attached to an annular frame member, a front portion of the annular shroud defining a visor portion;

a one-way exhaust valve received within an opening in the annular frame member, the one-way exhaust valve configured to allow an exhalation gas exhaled by a user to exit an interior of the integrated helmet and respirator system and to prevent or minimize ambient air from entering the interior of the integrated helmet and respirator system;

a neck dam extending downward from the frame and configured to prevent or minimize ambient air from entering the interior of the integrated helmet and respirator system.

2. The integrated helmet and respirator system of claim 1, wherein the helmet portion is formed of a ballistic-resistant material.

3. The integrated helmet and respirator system of claim 1, wherein the helmet portion is formed of a fiber reinforced composite material.

4. The integrated helmet and respirator system of claim 1, further comprising:

an edge trim member attached to the peripheral edge, the edge trim member including one or more fastener elements.

5. The integrated helmet and respirator system of claim 4, further comprising:

a sealing ring disposed between the edge trim member and the upper edge of the annular shroud.

6. The integrated helmet and respirator system of claim 1, further comprising:

one or more fasteners for removably attaching the helmet portion to the annular shroud.

7. The integrated helmet and respirator system of claim 6, wherein the one or more fasteners include a front fastener disposed on a front portion of the helmet portion and one or more rear fasteners disposed on a rear portion of the helmet portion.

8. The integrated helmet and respirator system of claim 7, wherein the front fastener is a tongue and groove fastener and each of the one or more rear fasteners is a latch fastener.

9. The integrated helmet and respirator system of claim 1, further comprising:

a sealing ring disposed between the helmet portion and the annular shroud; and one or more compression latches for securing the helmet portion to the annular portion, said one or more compression latches configured to apply a compressive force to the sealing ring to provide a sealing interference between the helmet portion and the annular shroud.

10. The integrated helmet and respirator system of claim 1, wherein the visor portion is sufficiently transparent to allow transvisualization therethrough.

11. The integrated helmet and respirator system of claim 1, wherein the visor portion includes an optical filter configured to filter one or more radiation wavelengths.

12. The integrated helmet and respirator system of claim 1, further comprising:

a respirator port on the annular frame configured to deliver a breathable gas to the interior of the integrated helmet and respirator system.

13. The integrated helmet and respirator system of claim 12, further comprising:

one or more air passageways formed within the frame to fluidically couple the interior of the integrated helmet and respirator system with a source of breathable gas attached to the respirator port.

14. The integrated helmet and respirator system of claim 1, further comprising:

a microphone disposed within the interior of the integrated helmet and respirator system; and communication wiring extending between the microphone and an electrical connector disposed on an exterior surface of the annular frame member, said electrical connector configured for connection to an external communication system.

15. The integrated helmet and respirator system of claim 14, further comprising:

the communication wiring passing through a wiring passageway integrally formed in said annular frame member.

16. The integrated helmet and respirator system of claim 1, further comprising:

a feeding connector disposed on an exterior surface of the annular frame member and configured for connection to an external source of food, hydration, or both; and a feeding passageway extending from the feeding connector to the interior of the integrated helmet and respirator system.

17. The integrated helmet and respirator system of claim 16, further comprising:

a feeding tube disposed within the interior of the integrated helmet and respirator system for providing a fluidic coupling between the feeding passageway and a user's mouth.

18. The integrated helmet and respirator system of claim 1, wherein the one-way exhaust valve includes a flexible valve diaphragm and a perforated valve seat member mounted in said opening in the annular frame member.

* * * * *